US011434443B2

(12) United States Patent
Bhowmik et al.

(10) Patent No.: US 11,434,443 B2
(45) Date of Patent: Sep. 6, 2022

(54) WATER-HYDROCARBON FUEL EMULSION

(71) Applicant: HINDUSTAN PETROLEUM CORPORATION LIMITED, Bangalore (IN)

(72) Inventors: Sandip Bhowmik, Bangalore (IN); Raghava Krishna Kanala, Bangalore (IN); Ravi Balasubramaniam, Bangalore (IN)

(73) Assignee: HINDUSTAN PETROLEUM CORPORATION LIMITED, Bangalore (IN)

( * ) Notice: Subject to any disclaimer, the term of this patent is extended or adjusted under 35 U.S.C. 154(b) by 0 days.

(21) Appl. No.: 17/594,377

(22) PCT Filed: Mar. 22, 2021

(86) PCT No.: PCT/IN2021/050295

§ 371 (c)(1),
(2) Date: Oct. 13, 2021

(87) PCT Pub. No.: WO2021/220290

PCT Pub. Date: Nov. 4, 2021

(65) Prior Publication Data

US 2022/0145200 A1 May 12, 2022

(30) Foreign Application Priority Data

Apr. 27, 2020 (IN) ..... 202041018009

(51) Int. Cl.
*C10L 1/32* (2006.01)

(52) U.S. Cl.
CPC ..... *C10L 1/328* (2013.01); *C10L 2250/084* (2013.01)

(58) Field of Classification Search
CPC ..... C10L 1/328; C10L 2250/084
See application file for complete search history.

(56) References Cited

U.S. PATENT DOCUMENTS

| | | | | |
|---|---|---|---|---|
| 4,297,107 | A | 10/1981 | Boehmke | |
| 4,722,757 | A * | 2/1988 | Cooper | C06B 47/145 149/83 |
| 5,851,245 | A * | 12/1998 | Moriyama | C10L 1/328 44/302 |
| 6,652,607 | B2 | 11/2003 | Langer et al. | |
| 2017/0321138 | A1 | 11/2017 | Fumagalli | |

FOREIGN PATENT DOCUMENTS

| | | | |
|---|---|---|---|
| EP | 2145940 | A1 | 1/2010 |
| WO | 2009004604 | A2 | 1/2009 |

OTHER PUBLICATIONS

European Patent Office, International Search Report and Written Opinion, from PCT/IN2021/050295, filed Mar. 22, 2021, dated Aug. 4, 2021.

* cited by examiner

*Primary Examiner* — Ellen M Mcavoy
*Assistant Examiner* — Ming Cheung Po
(74) *Attorney, Agent, or Firm* — Workman Nydegger

(57) ABSTRACT

The present disclosure discloses a water-hydrocarbon fuel emulsion comprising: a) 87-99% by weight of at least one hydrocarbon fuel with respect to the emulsion; b) 0.1-10% by weight of water with respect to the emulsion; c) 1-3% by weight of an emulsifying blend with respect to the emulsion; and d) 0.05-1% by weight of at least one inorganic hydride with respect to the emulsion, wherein the emulsifying blend comprises i) at least one oil-soluble nonionic surfactant; ii) at least one water-soluble nonionic surfactant; and iii) at least one ionic surfactant. The present disclosure also reveals a convenient preparation process of the water-hydrocarbon fuel emulsion.

16 Claims, No Drawings

WATER-HYDROCARBON FUEL EMULSION

FIELD OF THE INVENTION

The present disclosure in general relates to the field of hydrocarbon fuels and in particular the present disclosure relates to a composition of water-hydrocarbon fuel emulsion.

BACKGROUND OF THE INVENTION

Efficiency of a conventional internal combustion gasoline engine critically depends on the maximum compression the fuel can tolerate, which is reflected by the higher octane rating of the fuel. Typically, in order to achieve a higher octane number, the fuel is blended with more reformates and isomerates. But with the growing concerns over environmental impact and stringent environmental regulations, the addition of aromatics and olefins to combustion fuel is being restricted. Alternatively, ethanol and to a lower extent higher alcohols are being blended to improve the octane number. However, inadequate production of ethanol has prompted researchers to develop alternative octane boosting additives. Ethers, such as ethyl-tert butyl ether (ETBE), methyl-tert butyl ether (MTBE) along with certain aniline derivatives have proved to be efficient octane booster. But the use of such additives have been restricted due to their negative impact on the environment.

Several organometallic compounds have also emerged as a suitable alternative for the octane boosting ether derivatives, such as methylcyclopentadienyl manganese tricarbonyl (MMT), ferrocene, and the like. But similar concerns raised over the environmental impact have restricted their use in several countries. Several different organic derivatives have been investigated as a potential candidate for new octane booster, such as furfural and its derivatives, guaiacol and its derivatives, lignin, dicyclopentadiene, carbon nanotubes and its derivatives, etc. But most of them suffer from solubility, aromatic toxicity, or bulk availability issues.

WO2009004604A2 discloses a fuel emulsion having a three-phase composition, comprising a continuous hydrocarbon, a cavitation water vapor bubbles dispersed in the hydrocarbon and dispersed water droplets dispersed. U.S. Pat. No. 6,652,607B2 discloses an aqueous hydrocarbon fuel emulsion comprising water, fuel, and an emulsifier comprising an amino alkylphenol.

However, the greatest challenge in developing such a system remains in poor miscibility and a large difference in density between the two phases. Although there are numerous efforts attempted, there is still a need in the state of art for obtaining a homogenous transparent emulsion of a hydrocarbon fuel with enhanced octane number.

SUMMARY OF THE INVENTION

In an aspect of the present disclosure, there is provided a water-hydrocarbon fuel emulsion comprising: a) 87-99% by weight of at least one hydrocarbon fuel with respect to the emulsion; b) 0.1-10% by weight of water with respect to the emulsion; c) 1-3% by weight of an emulsifying blend with respect to the emulsion; and d) 0.05-1% by weight of at least one inorganic hydride with respect to the emulsion, wherein the emulsifying blend comprises i) at least one oil soluble nonionic surfactant; ii) at least one water soluble nonionic surfactant; and iii) at least one ionic surfactant.

In another aspect of the disclosure, there is provided a water-hydrocarbon fuel emulsion comprising: a) 87-99% by weight of at least one hydrocarbon fuel with respect to the emulsion; b) 0.1-10% by weight of water with respect to the emulsion; c) 1-3% by weight of an emulsifying blend with respect to the emulsion; and d) 0.05-1% by weight of at least one inorganic hydride with respect to the emulsion, wherein the emulsifying blend comprises i) 1.2 to 2.0% by weight of at least one oil soluble nonionic surfactant with respect to the emulsion, ii) 0.5-1.0% by weight of at least one water soluble nonionic surfactant with respect to the emulsion, and iii) 0.0001 to 0.0005% by weight of at least one ionic surfactant with respect to the emulsion.

In yet another aspect of the present disclosure, there is provided a process for preparing the water-hydrocarbon emulsion, the process comprising: a) mixing the at least one oil soluble nonionic surfactant with the at least one hydrocarbon fuel to obtain a first mixture; b) dissolving the at least one water soluble nonionic surfactant in water to obtain a second mixture; c) adding the at least one ionic surfactant to the second mixture to obtain a third mixture; d) blending the first mixture and the third mixture to obtain a transparent mixture; and e) dissolving the at least one inorganic hydride with the transparent mixture to obtain the water-hydrocarbon fuel emulsion.

These and other features, aspects, and advantages of the present subject matter will be better understood with reference to the following description and appended claims. This summary is provided to introduce a selection of concepts in a simplified form. This summary is not intended to identify key features or essential features of the claimed subject matter, nor is it intended to be used to limit the scope of the claimed subject matter.

DETAILED DESCRIPTION OF THE INVENTION

Those skilled in the art will be aware that the present disclosure is subject to variations and modifications other than those specifically described. It is to be understood that the present disclosure includes all such variations and modifications. The disclosure also includes all such steps, features, compositions and compounds referred to or indicated in this specification, individually or collectively, and any and all combinations of any or more of such steps or features.

Definitions

For convenience, before further description of the present disclosure, certain terms employed in the specification, and examples are collected here. These definitions should be read in the light of the remainder of the disclosure and understood as by a person of skill in the art. The terms used herein have the meanings recognized and known to those of skill in the art, however, for convenience and completeness, particular terms and their meanings are set forth below.

The articles "a", "an" and "the" are used to refer to one or to more than one (i.e., to at least one) of the grammatical object of the article.

The terms "comprise" and "comprising" are used in the inclusive, open sense, meaning that additional elements may be included. It is not intended to be construed as "consists of only".

The term "emulsion" refers to a mixture of two or more liquids that are normally immiscible into a single homogeneous phase where one or more liquids are present as a dispersed phase in another liquid constituting the continuous phase. In the present disclosure, the term refers to a mixture of hydrocarbon fuel and water that forms an emulsion in the presence of an emulsifying blend where water being the dispersed phase in the continuous hydrocarbon phase.

The term "emulsifying blend" used herein refers to a component that can mix two immiscible liquid phases into one homogenous phase. In general, the emulsifying blend comprised the surfactants. In the present disclosure, the emulsifying blend comprises nonionic surfactants and ionic surfactants.

The term "surfactant" refers to a chemical substance that alters interfacial properties by absorbing the boundary between two immiscible phases. These surfactants are also called as surface active agents and stabilize the interface. In the present disclosure, surfactant refers to water soluble nonionic surfactants, oil soluble nonionic surfactant and ionic surfactant.

The term "nonionic surfactant" used herein refers to are surfactants that do not dissociate into ions in aqueous solutions, and they are subclassified depending on the type of their hydrophilic/lipophilic group. Nonionic surfactants having a hydrophilic group are referred to as "water soluble nonionic surfactant" and nonionic surfactants having a lipophilic group are referred to as "oil soluble nonionic surfactant". In the present disclosure, the water soluble nonionic surfactant is not limited to tween 20, tergitol, Triton X, PEG-200, glycerol monolaurate, nonoxynol-9, polysorbate 80, tween 40, or polyoxyethylene lauryl ether; and the oil soluble nonionic surfactant is not limited to span 80, lauramide diethyl amine, glycerol tristearate, sorbitan monopalmitate, span 20, polysorbate 20, glycerol monooleate, or sucrose stearate.

The term "ionic surfactant" used herein refers to surfactants comprising hydrophilic group that dissociates into anions and cations when contact with water based on pH. In the present disclosure, the ionic surfactant refers to the anionic surfactant and is not limited to sodium octyl sulfate, sodium dodecyl sulfate, magnesium stearate, 3-(N,N-dimethylpalmitylammonio)propanesulfonate or ammonium lauryl sulfate.

The term "inorganic hydride" used herein refers to a compound having hydride as anion with an inorganic component. In the present disclosure, inorganic hydride also refers to a hydride compound or hydrogen producing compound that acts as a reducing agent. The term inorganic hydride used herein refers to a compound capable of producing/transferring hydride anion in situ. Inorganic hydride and inorganic hydride reducing agent can be used interchangeably. In the present disclosure, examples of inorganic hydride are not limited to borane-tetrahydrofuran, borane-dimethylsulphide, lithium aluminum hydride, sodium borohydride.

The term "thermoreversible" used herein refers to a property of substances to be reversed when exposed to heat. In the present disclosure, the term "thermoreversible" represents the property particularly transparency of the emulsion disclosed herein.

The term "hydrophilic-lipophilic balance (HLB)" used herein refers to an indicator that quantifies the relative balance of various surfactants. In general, the solubility of nonionic surfactants depends on the balance between the hydrophilic group's capacity of attracting water and the lipophilic group's capacity of attracting oil, which is indicated by HLB value. HLB can be used as a reference to choose a surfactant for a specific application. In the present disclosure, the HLB of the emulsion is maintained in the range of 7-9.

The term "octane number" used herein refers to a standard measure of the performance of an engine/ combustion fuel. Octane number is the measure fuel's knock resistance or the anti-knocking efficiency. In the present disclosure, the octane number refers to research octane number (RON) which describes the behavior of the fuel in the engine at lower temperatures and speeds. RON is determined by running the fuel in a test engine with a variable compression ratio under controlled conditions and comparing the results with those for mixtures of iso-octane and n-heptane. The terms "octane number" and "research octane number (RON)" can be used interchangeably.

Throughout this specification, unless the context requires otherwise the word "comprise", and variations such as "comprises" and "comprising", will be understood to imply the inclusion of a stated element or step or group of element or steps but not the exclusion of any other element or steps.

The term "including" is used to mean "including but not limited to", "including" and "including but not limited to" are used interchangeably.

Unless defined otherwise, all technical and scientific terms used herein have the same meaning as commonly understood to one of ordinary skill in the art to which this disclosure belongs. Although methods and materials similar or equivalent to those described herein can be used in the practice or testing of the disclosure, the preferred methods, and materials are now described. All publications mentioned herein are incorporated herein by reference.

Ratios, concentrations, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a weight percentage of about 0.1% to 10% should be interpreted to include not only the explicitly recited limits of about 0.1% and 10%, but also to include sub-ranges, such as 1-7%, 5-10%, and so forth, as well as individual amounts, including fractional amounts, within the specified ranges, such as 1.9%, 5.5%, 8.2%, for example.

The present disclosure is not to be limited in scope by the specific embodiments described herein, which are intended for the purposes of exemplification only. Functionally equivalent products, compositions, and methods are clearly within the scope of the disclosure, as described herein.

As discussed in the background, there were various additives used for improving the octane number of the combustion fuel. The well-known fuel modifications were made using water or methanol/ethanol to improve the octane number. But the challenge yet to be addressed was the miscibility of water and hydrocarbon fuel. In favor of obtaining a fuel with improved combustion property, the foremost criterion is the miscibility of water with the hydrocarbon fuel to result in a homogenous and a transparent emulsion. In order to serve this purpose, surfactants of varying categories and varying compositions suitable to prepare a desired water-hydrocarbon fuel emulsion were studied.

The present disclosure discloses a water-hydrocarbon fuel emulsion comprising water, hydrocarbon fuel, an emulsifying blend and an inorganic hydride. The emulsifying blend comprises oil soluble nonionic surfactants, water soluble nonionic surfactants and ionic surfactants. The surfactants were chosen in suitable proportions to obtain a transparent emulsion. The addition of the inorganic hydride provides surprisingly positive results towards the octane number of the hydrocarbon fuel. The present disclosure also provides a process for preparing the water-hydrocarbon fuel emulsion which is to be performed in a particular sequence. In a nutshell, the present disclosure provides a proficient composition and a competitive process for obtaining a homogenous transparent water-hydrocarbon emulsion.

In an embodiment of the present disclosure, there is provided water-hydrocarbon fuel emulsion comprising: a) 87-99% by weight of at least one hydrocarbon fuel with respect to the emulsion; b) 0.1-10% by weight of water with respect to the emulsion; c) 1-3% by weight of an emulsifying blend with respect to the emulsion; and d) 0.05-1% by weight of at least one inorganic hydride with respect to the emulsion, wherein the emulsifying blend comprises i) at least one oil-soluble nonionic surfactant; ii) at least one water-soluble nonionic surfactant; and iii) at least one ionic surfactant.

In an embodiment of the present disclosure, there is provided water-hydrocarbon fuel emulsion comprising: a) 89-98.5% by weight of at least one hydrocarbon fuel with respect to the emulsion; b) 0.2-5% by weight of water with respect to the emulsion; c) 1.5-2.5% by weight of an emulsifying blend with respect to the emulsion; and d) 0.05-1% by weight of at least one inorganic hydride with respect to the emulsion, wherein the emulsifying blend comprises i) at least one oil-soluble nonionic surfactant; ii) at least one water-soluble nonionic surfactant; and iii) at least one ionic surfactant.

In an embodiment of the present disclosure, there is provided a water-hydrocarbon fuel emulsion comprising: a) 95-98% by weight of at least one hydrocarbon fuel with respect to the emulsion; b) 0.3-2.0% by weight of water with respect to the emulsion; c) 2.0-2.5% by weight of an emulsifying blend with respect to the emulsion; and d) 0.1-0.3% by weight of at least one inorganic hydride with respect to the emulsion, wherein the emulsifying blend comprises i) at least one oil-soluble nonionic surfactant; ii) at least one water-soluble nonionic surfactant; and iii) at least one ionic surfactant.

In an embodiment of the present disclosure, there is provided water-hydrocarbon fuel emulsion comprising: a) 87-99% by weight of at least one hydrocarbon fuel with respect to the emulsion; b) 0.1-10% by weight of water with respect to the emulsion; c) 1-3% by weight of an emulsifying blend with respect to the emulsion; and d) 0.05-1% by weight of at least one inorganic hydride with respect to the emulsion, wherein the emulsifying blend comprises a) at least one oil-soluble nonionic surfactant; b) at least one water-soluble nonionic surfactant; and c) at least one ionic surfactant, wherein the at least one hydrocarbon fuel is selected from a group consisting of gasoline, base fuel, fuel, crude oil, diesel fuel, kerosene, gas oil, hydrocarbon oil, and combinations thereof.

In an embodiment of the present disclosure, there is provided water-hydrocarbon fuel emulsion as disclosed herein, wherein the at least one hydrocarbon fuel is selected from a group consisting of gasoline, base fuel, fuel, crude oil, diesel fuel, kerosene, gas oil, hydrocarbon oil, and combinations thereof. In another embodiment of the present disclosure, wherein the at least one hydrocarbon fuel is gasoline.

In an embodiment of the present disclosure, there is provided a water-hydrocarbon fuel emulsion comprising: a) 87-99% by weight of at least one hydrocarbon fuel with respect to the emulsion; b) 0.1-10% by weight of water with respect to the emulsion; c) 1-3% by weight of an emulsifying blend with respect to the emulsion; and d) 0.05-1% by weight of at least one inorganic hydride with respect to the emulsion, wherein the emulsifying blend comprises 1.2-2.0% by weight of at least one oil-soluble nonionic surfactant with respect to the emulsion, 0.5-1.0% by weight of at least one water-soluble nonionic surfactant with respect to the emulsion, and 0.0001 to 0.0005% by weight of at least one ionic surfactant with respect to the emulsion.

In an embodiment of the present disclosure, there is provided a water-hydrocarbon fuel emulsion as disclosed herein, wherein the emulsifying blend comprises 1.2-2.0% by weight of at least one oil-soluble nonionic surfactant with respect to the emulsion, 0.5-1.0% by weight of at least one water-soluble nonionic surfactant with respect to the emulsion, and 0.0001 to 0.0005% by weight of at least one ionic surfactant with respect to the emulsion. In another embodiment of the present disclosure, wherein the emulsifying blend comprises 1.2 to 1.8% by weight of at least one oil-soluble nonionic surfactant with respect to the emulsion, 0.6-0.8% by weight of at least one water-soluble nonionic surfactant with respect to the emulsion, and 0.0015 to 0.0004% by weight of at least one ionic surfactant with respect to the emulsion. In yet another embodiment of the present disclosure, wherein the emulsifying blend comprises 1.4 to 1.5% by weight of at least one oil-soluble nonionic surfactant with respect to the emulsion, 0.70-0.75% by weight of at least one water-soluble nonionic surfactant with respect to the emulsion, and 0.0003 to 0.0004% by weight of at least one ionic surfactant with respect to the emulsion.

In an embodiment of the present disclosure, there is provided water-hydrocarbon fuel emulsion comprising: a) 87-99% by weight of at least one hydrocarbon fuel with respect to the emulsion; b) 0.1-10% by weight of water with respect to the emulsion; c) 1-3% by weight of an emulsifying blend with respect to the emulsion; and d) 0.05-1% by weight of at least one inorganic hydride with respect to the emulsion, wherein the emulsifying blend comprises a) at least one oil-soluble nonionic surfactant; b) at least one water-soluble nonionic surfactant; and c) at least one ionic surfactant, wherein the at least one oil-soluble nonionic surfactant is selected from a group consisting of span 80, lauramide diethyl amine, glycerol tristearate, sorbitan monopalmitate, span 20, polysorbate 20, glycerol monooleate, sucrose stearate, and combinations thereof.

In an embodiment of the present disclosure, there is provided a water-hydrocarbon fuel emulsion as disclosed herein, wherein the at least one oil-soluble nonionic surfactant is selected from a group consisting of span 80, lauramide diethyl amine, glycerol tristearate, sorbitan monopalmitate, span 20, polysorbate 20, glycerol monooleate, sucrose stearate, and combinations thereof. In another embodiment of the present disclosure, wherein the at least one oil-soluble nonionic surfactant is span 80.

In an embodiment of the present disclosure, there is provided a water-hydrocarbon fuel emulsion comprising: a) 87-99% by weight of at least one hydrocarbon fuel with respect to the emulsion; b) 0.1-10% by weight of water with respect to the emulsion; c) 1-3% by weight of an emulsifying blend with respect to the emulsion; and d) 0.05-1% by weight of at least one inorganic hydride with respect to the emulsion, wherein the emulsifying blend comprises a) at least one oil-soluble nonionic surfactant; b) at least one water-soluble nonionic surfactant; and c) at least one ionic surfactant, wherein the at least one water-soluble nonionic surfactant is selected from a group consisting of tween 20, tergitol, Triton X, PEG-200, glycerol monolaurate, nonoxynol-9, polysorbate 80, tween 40, polyoxyethylene lauryl ether, and combinations thereof.

In an embodiment of the present disclosure, there is provided a water-hydrocarbon fuel emulsion as disclosed herein, wherein the at least one water-soluble nonionic surfactant is selected from a group consisting of tween 20, tergitol, Triton X, PEG-200, glycerol monolaurate, nonoxynol-9, polysorbate 80, tween 40, polyoxyethylene lauryl ether, and combinations thereof. In another embodiment of the present disclosure, wherein the at least one water-soluble nonionic surfactant is tween 20.

In an embodiment of the present disclosure, there is provided a water-hydrocarbon fuel emulsion comprising: a) 87-99% by weight of at least one hydrocarbon fuel with respect to the emulsion; b) 0.1-10% by weight of water with respect to the emulsion; c) 1-3% by weight of an emulsifying blend with respect to the emulsion; and d) 0.05-1% by weight of at least one inorganic hydride with respect to the emulsion, wherein the emulsifying blend comprises a) at least one oil-soluble nonionic surfactant; b) at least one water-soluble nonionic surfactant; and c) at least one ionic surfactant, wherein the at least one ionic surfactant is selected from the group consisting of sodium octyl sulfate, sodium dodecyl sulfate, magnesium stearate, 3-(N,N-dimethylpalmitylammonio)propanesulfonate, ammonium lauryl sulfate, and combinations thereof.

In an embodiment of the present disclosure, there is provided a water-hydrocarbon fuel emulsion as disclosed herein, wherein the at least one ionic surfactant is selected from the group consisting of sodium octyl sulfate, sodium dodecyl sulfate, magnesium stearate, 3-(N,N-dimethylpalmitylammonio)propanesulfonate, ammonium lauryl sulfate, and combinations thereof. In another embodiment of the present disclosure, wherein the at least one ionic surfactant is sodium dodecyl sulphate.

In an embodiment of the present disclosure, there is provided water-hydrocarbon fuel emulsion comprising: a) 87-99% by weight of at least one hydrocarbon fuel with respect to the emulsion; b) 0.1-10% by weight of water with respect to the emulsion; c) 1-3% by weight of an emulsifying blend with respect to the emulsion; and d) 0.05-1% by weight of at least one inorganic hydride with respect to the emulsion, wherein the emulsifying blend comprises a) at least one oil-soluble nonionic surfactant; b) at least one water-soluble nonionic surfactant; and c) at least one ionic surfactant, wherein the at least one inorganic hydride is selected from a group consisting of borane-tetrahydrofuran, borane-dimethylsulphide, lithium aluminum borohydride, sodium borohydride, and combinations thereof.

In an embodiment of the present disclosure, there is provided a water-hydrocarbon fuel emulsion as disclosed herein, wherein the at least one inorganic hydride is selected from a group consisting of borane-tetrahydrofuran, borane-dimethylsulphide, lithium aluminum borohydride, sodium borohydride, and combinations thereof. In another embodiment of the present disclosure, wherein the at least one inorganic hydride is borane-tetrahydrofuran.

In an embodiment of the present disclosure, there is provided a water-hydrocarbon fuel emulsion comprising: a) 87-99% by weight of at least one hydrocarbon fuel selected from the group consisting of gasoline, base fuel, fuel, crude oil, diesel fuel, kerosene, gas oil, hydrocarbon oil, and combinations thereof; b) 0.1-10% by weight of water with respect to the emulsion; c) 1-3% by weight of an emulsifying blend with respect to the emulsion; and d) 0.05-1% by weight of at least one inorganic hydride selected from a group consisting of borane-tetrahydrofuran, borane-dimethylsulphide, lithium aluminum borohydride, sodium borohydride, and combinations thereof, wherein the emulsifying blend comprises i) 1.2-2.0% by weight of at least one oil-soluble nonionic surfactant selected from a group consisting of span 80, lauramide diethyl amine, glycerol tristearate, sorbitan monopalmitate, span 20, polysorbate 20, glycerol monooleate, sucrose stearate, and combinations thereof, ii) 0.5-1.0% by weight of at least one water-soluble nonionic surfactant selected from a group consisting of tween 20, tergitol, Triton X, PEG-200, glycerol monolaurate, nonoxynol-9, polysorbate 80, tween 40, polyoxyethylene lauryl ether, and combinations thereof, and iii) 0.0001-0.0005% by weight of at least one ionic surfactant selected from the group consisting of sodium octyl sulfate, sodium dodecyl sulfate, magnesium stearate, 3-(N,N-dimethylpalmitylammonio)propanesulfonate, ammonium lauryl sulfate, and combinations thereof.

In an embodiment of the present disclosure, there is provided a water-hydrocarbon fuel emulsion as disclosed herein, wherein the water-hydrocarbon fuel emulsion has a hydrophilic-lipophilic balance (HLB) in the range of 7 to 9. In another embodiment of the present disclosure, wherein the water-hydrocarbon fuel emulsion has a hydrophilic-lipophilic balance (HLB) in the range of 7 to 8.

In an embodiment of the present disclosure, there is provided a water-hydrocarbon fuel emulsion as disclosed herein, wherein the water-hydrocarbon fuel emulsion is thermoreversible at a temperature in the range of 10° C. to 60° C. In another embodiment of the present disclosure, wherein the water-hydrocarbon fuel emulsion is thermoreversible in the range of 25° C. to 35° C.

In an embodiment of the present disclosure, there is provided a water-hydrocarbon fuel emulsion as disclosed herein, wherein the water-hydrocarbon fuel emulsion has transmittance values in the range of 0.1 to 100. In another embodiment of the present disclosure, wherein the water-hydrocarbon fuel emulsion has transmittance values in the range of 0.1-35.

In an embodiment of the present disclosure, there is provided a water-hydrocarbon fuel emulsion as disclosed herein, wherein the water-hydrocarbon fuel emulsion has an octane number in the range of 90 to 96. In another embodiment of the present disclosure, wherein the octane number is in the range of 92-95.

In an embodiment of the present disclosure, there is provided a process for preparing the water-hydrocarbon emulsion, the process comprising: a) mixing the at least one oil-soluble nonionic surfactant with the at least one hydrocarbon fuel to obtain a first mixture; b) dissolving the at least one water-soluble nonionic surfactant in water to obtain a second mixture; c) adding the at least one ionic surfactant to the second mixture to obtain a third mixture; d) blending the first mixture and the third mixture to obtain a transparent mixture; and e) dissolving the at least one inorganic hydride with the transparent mixture to obtain the water-hydrocarbon fuel emulsion.

In an embodiment of the present disclosure, there is provided a process for preparing the water-hydrocarbon emulsion, the process comprising: a) mixing the at least one oil-soluble nonionic surfactant with the at least one hydrocarbon fuel is carried out under constant stirring for a time period in the range of 5 to 20 minutes to obtain a first mixture; b) dissolving the at least one water-soluble nonionic surfactant in water to obtain a second mixture; c) adding the at least one ionic surfactant to the second mixture to obtain a third mixture; d) blending the first mixture and the third mixture to obtain a transparent mixture; and e)

dissolving the at least one inorganic hydride with the transparent mixture to obtain the water-hydrocarbon fuel emulsion.

In an embodiment of the present disclosure, there is provided a process for preparing the water-hydrocarbon emulsion, the process comprising: a) mixing the at least one oil-soluble nonionic surfactant selected from a group consisting of span 80, lauramide diethyl amine, glycerol tristearate, sorbitan monopalmitate, span 20, polysorbate 20, glycerol monooleate, sucrose stearate, and combinations thereof with the at least one hydrocarbon fuel selected from a group consisting of gasoline, base fuel, fuel, crude oil, diesel fuel, kerosene, gas oil, hydrocarbon oil, and combinations thereof, is carried out under constant stirring for a time period in the range of 5 to 20 minutes to obtain a first mixture; b) dissolving the at least one water-soluble nonionic surfactant in water to obtain a second mixture; c) adding the at least one ionic surfactant to the second mixture to obtain a third mixture; d) blending the first mixture and the third mixture to obtain a transparent mixture; and e) dissolving the at least one inorganic hydride with the transparent mixture to obtain the water-hydrocarbon fuel emulsion.

In an embodiment of the present disclosure, there is provided a process for preparing the water-hydrocarbon emulsion, the process comprising: a) mixing the at least one oil-soluble nonionic surfactant with the at least one hydrocarbon fuel to obtain a first mixture; b) dissolving the at least one water-soluble nonionic surfactant selected from a group consisting of tween 20, tergitol, Triton X, PEG-200, glycerol monolaurate, nonoxynol-9, polysorbate 80, tween 40, polyoxyethylene lauryl ether, and combinations thereof in water to obtain a second mixture; c) adding the at least one ionic surfactant to the second mixture to obtain a third mixture; d) blending the first mixture and the third mixture to obtain a transparent mixture; and e) dissolving the at least one inorganic hydride with the transparent mixture to obtain the water-hydrocarbon fuel emulsion.

In an embodiment of the present disclosure, there is provided a process for preparing the water-hydrocarbon emulsion, the process comprising: a) mixing the at least one oil-soluble nonionic surfactant with the at least one hydrocarbon fuel to obtain a first mixture; b) dissolving the at least one water-soluble nonionic surfactant in water to obtain a second mixture; c) adding the at least one ionic surfactant to the second mixture is carried out at a temperature in the range of 70° C. to 90° C. under constant stirring to obtain a third mixture; d) blending the first mixture and the third mixture to obtain a transparent mixture; and e) dissolving the at least one inorganic hydride with the transparent mixture to obtain the water-hydrocarbon fuel emulsion.

In an embodiment of the present disclosure, there is provided a process for preparing the water-hydrocarbon emulsion, the process comprising: a) mixing the at least one oil-soluble nonionic surfactant with the at least one hydrocarbon fuel to obtain a first mixture; b) dissolving the at least one water-soluble nonionic surfactant in water to obtain a second mixture; c) adding the at least one ionic surfactant selected from the group consisting of sodium octyl sulfate, sodium dodecyl sulfate, magnesium stearate, 3-(N,N-dimethylpalmitylammonio)propanesulfonate, ammonium lauryl sulfate, and combinations thereof to the second mixture is carried out at a temperature in the range of 70° C. to 90° C. under constant stirring to obtain a third mixture; d) blending the first mixture and the third mixture to obtain a transparent mixture; and e) dissolving the at least one inorganic hydride with the transparent mixture to obtain the water-hydrocarbon fuel emulsion.

In an embodiment of the present disclosure, there is provided a process for preparing the water-hydrocarbon emulsion, the process comprising: a) mixing the at least one oil-soluble nonionic surfactant with the at least one hydrocarbon fuel to obtain a first mixture; b) dissolving the at least one water-soluble nonionic surfactant in water to obtain a second mixture; c) adding the at least one ionic surfactant to the second mixture at a temperature in the range of 70° C. to 90° C. under constant stirring to obtain a third mixture; d) blending the first mixture and the third mixture to obtain a transparent mixture; and e) dissolving the at least one inorganic hydride with the transparent mixture to obtain the water-hydrocarbon fuel emulsion.

In an embodiment of the present disclosure, there is provided a process for preparing the water-hydrocarbon emulsion, the process comprising: a) mixing the at least one oil-soluble nonionic surfactant with the at least one hydrocarbon fuel to obtain a first mixture; b) dissolving the at least one water-soluble nonionic surfactant in water to obtain a second mixture; c) adding the at least one ionic surfactant to the second mixture to obtain a third mixture; d) blending the first mixture and the third mixture to obtain a transparent mixture; and e) dissolving the at least one inorganic hydride with the transparent mixture to obtain the water-hydrocarbon fuel emulsion and wherein blending the first mixture and the third mixture is carried out by maintaining the first mixture at a temperature in the range of 0° C. to 5° C.

In an embodiment of the present disclosure, there is provided a process for preparing the water-hydrocarbon emulsion, the process comprising: a) mixing the at least one oil-soluble nonionic surfactant with the at least one hydrocarbon fuel to obtain a first mixture; b) dissolving the at least one water-soluble nonionic surfactant in water to obtain a second mixture; c) adding the at least one ionic surfactant to the second mixture to obtain a third mixture; d) blending the first mixture and the third mixture is done by drop-wise addition of the third mixture to the first mixture for a time period in the range of 1-30 minutes to obtain a transparent mixture and is further subjected to sonication for a time period in the range of 15-60 minutes; and e) dissolving the at least one inorganic hydride with the transparent mixture to obtain the water-hydrocarbon fuel emulsion.

In an embodiment of the present disclosure, there is provided a process for preparing the water-hydrocarbon emulsion, the process comprising: a) mixing the at least one oil-soluble nonionic surfactant with the at least one hydrocarbon fuel to obtain a first mixture; b) dissolving the at least one water-soluble nonionic surfactant in water to obtain a second mixture; c) adding the at least one ionic surfactant to the second mixture to obtain a third mixture; d) blending the first mixture and the third mixture to obtain a transparent mixture; and e) dissolving the at least one inorganic hydride with the transparent mixture is carried out at a temperature in the range of 25° C. to 40° C. to obtain the water-hydrocarbon fuel emulsion.

In an embodiment of the present disclosure, there is provided a process for preparing the water-hydrocarbon emulsion, the process comprising: a) mixing the at least one oil-soluble nonionic surfactant with the at least one hydrocarbon fuel to obtain a first mixture; b) dissolving the at least one water-soluble nonionic surfactant in water to obtain a second mixture; c) adding the at least one ionic surfactant to the second mixture to obtain a third mixture; d) blending the first mixture and the third mixture to obtain a transparent mixture; and e) dissolving the at least one inorganic hydride selected from a group consisting of borane-tetrahydrofuran, borane-dimethylsulphide, lithium aluminum borohydride, sodium borohydride, and combinations thereof with the transparent mixture is carried out at a temperature in the range of 25° C. to 40° C. to obtain the water-hydrocarbon fuel emulsion.

In an embodiment of the present disclosure, there is provided a process for preparing the water-hydrocarbon emulsion a) 87-99% by weight of at least one hydrocarbon fuel with respect to the emulsion; b) 0.1-10% by weight of water with respect to the emulsion; c) 1-3% by weight of an emulsifying blend comprising i) at least one oil-soluble nonionic surfactant; ii) at least one water-soluble nonionic surfactant; and iii) at least one ionic surfactant with respect to the emulsion; and d) 0.05-1% by weight of at least one inorganic hydride, the process comprising: a) mixing the at least one oil-soluble nonionic surfactant with the at least one hydrocarbon fuel to obtain a first mixture; b) dissolving the at least one water-soluble nonionic surfactant in water to obtain a second mixture; c) adding the at least one ionic surfactant to the second mixture to obtain a third mixture; d) blending the first mixture and the third mixture to obtain a transparent mixture; and e) dissolving the at least one inorganic hydride with the transparent mixture to obtain the water-hydrocarbon fuel emulsion.

In an embodiment of the present disclosure, there is provided a process for preparing the water-hydrocarbon fuel, the process comprising: a) mixing 1.2-2.0% by weight of at least one oil-soluble nonionic surfactant with 87-99% by weight of at least one hydrocarbon fuel to obtain a first mixture; b) dissolving 0.5-1.0% by weight of at least one water-soluble nonionic surfactant in 0.1-10% by weight of water to obtain a second mixture; c) adding 0.0001 to 0.0005% by weight of at least one ionic surfactant to the second mixture to obtain a third mixture; d) blending the first mixture and the third mixture to obtain a transparent mixture; and e) dissolving 0.05-1.0% by weight of at least one inorganic hydride with the transparent mixture to obtain the water-hydrocarbon fuel emulsion.

In an embodiment of the present disclosure, the water-hydrocarbon fuel emulsion for use as combustion fuel, as engine fuel or as aviation fuel.

Although the subject matter has been described in considerable detail with reference to certain preferred embodiments thereof, other embodiments are possible.

EXAMPLES

The disclosure will now be illustrated with working examples, which is intended to illustrate the working of disclosure and not intended to take restrictively to imply any limitations on the scope of the present disclosure. Unless defined otherwise, all technical and scientific terms used herein have the same meaning as commonly understood to one of ordinary skill in the art to which this disclosure belongs. Although methods and materials similar or equivalent to those described herein can be used in the practice of the disclosed methods and compositions, the exemplary methods, devices and materials are described herein. It is to be understood that this disclosure is not limited to particular methods, and experimental conditions described, as such methods and conditions may apply.

With an aim to obtain a transparent, homogenous water-hydrocarbon fuel emulsion, the present disclosure attempted on the combination of various surfactants. The essential requirement of the water-hydrocarbon fuel was to attain a high octane number. Thus the present disclosure provides an indigenous composition for water-hydrocarbon fuel emulsion comprising hydrocarbon fuel, water, emulsifying blend and inorganic hydride. The emulsifying blend comprises oil soluble nonionic surfactants, water soluble nonionic surfactants and ionic surfactant. The weight percentages of these surfactants were suitably chosen to obtain a transparent emulsion. The preparation of water-hydrocarbon emulsion is a sequential preparation process and any change in the sequence would not result in a transparent emulsion. Accordingly, the optimized preparation process was identified and is explained herein

Example 1

Water-Hydrocarbon Emulsion of the Present Disclosure

The water-hydrocarbon emulsion of the present disclosure comprised 87-99% by weight of at least one hydrocarbon fuel, 0.1-10% by weight of water, 1-3% by weight of the emulsifying blend comprising 1.2-2.0% by weight of at least one oil-soluble nonionic surfactant, 0.5-1.0% by weight of at least one water-soluble nonionic surfactant, and 0.0001-0.0005% by weight of at least one ionic surfactant and 0.05-1% by weight of at least one inorganic hydride.

The hydrocarbon fuel is selected from the group consisting of gasoline, base fuel, fuel, crude oil, diesel fuel, kerosene, gas oil or hydrocarbon oil. The water used in the present disclosure, have total organic carbon (TOC) in the range of 3-5 ppb of water and has a resistivity greater than 10 MSΩ cm. The oil soluble nonionic surfactant is selected from span 80, lauramide diethyl amine, glycerol tristearate, sorbitan monopalmitate, span 20, polysorbate 20, glycerol monooleate or sucrose stearate. The water soluble nonionic surfactant is selected from tween 20, tergitol, Triton X, PEG-200, glycerol monolaurate, nonoxynol-9, polysorbate 80, tween 40 or polyoxyethylene lauryl ether. The ionic surfactant is selected from sodium octyl sulfate, sodium dodecyl sulfate, magnesium stearate, 3-(N,N-dimethylpalmitylammonio)propanesulfonate or ammonium lauryl sulfate. And the inorganic hydride is selected from borane-tetrahydrofuran, borane-dimethylsulphide, lithium aluminum borohydride or sodium borohydride.

In the present disclosure, the hydrocarbon fuel was gasoline blended with water, emulsifying blend and the inorganic hydride. The surfactants used in the examples were span 80 (oil-soluble nonionic surfactant), tween 20 (water-soluble nonionic surfactant) and sodium dodecyl sulphate (ionic surfactant). The inorganic hydride used was borane-tetrahydrofuran. Table 1 explains the varying weight percentages of the various components in obtaining the water-hydrocarbon fuel emulsion. The prepared emulsions were tested for HLB value, emulsion appearance and the respective research octane number and the results obtained are recorded in Table 1.

TABLE 1

| S. No | Hydrocarbon fuel (% weight) | Water (% weight) | Emulsifying blend (% weight) Span 80 | Tween 20 | Sodium dodecyl sulphate | Inorganic Hydride (Borane-Tetrahydrofuran) (% weight) | HLB value | Emulsion Appearance | Research Octane number |
|---|---|---|---|---|---|---|---|---|---|
| 1 | 100 | 0 | 0 | 0 | 0 | 0 | 0 | Transparent | 91.4 |
| 2 | 99.1 | 0.65 | 0.088 | 0.0417 | 0.0003 | 0.12 | 9.2 | Milky | NA |
| 3 | 98.98 | 0.646 | 0.176 | 0.0827 | 0.0003 | 0.115 | 9.21 | Milky | NA |
| 4 | 97.12 | 0.6347 | 1.066 | 1.066 | 0.0003 | 0.113 | 10.5 | Translucent/hazy | 91.9 |
| 5 | 97.11 | 0.6344 | 1.4363 | 0.706 | 0.0003 | 0.113 | 7.84 | Transparent | 92.6 |
| 6 | 95.853 | 1.898 | 1.4321 | 0.704 | 0.0003 | 0.1126 | 7.84 | Transparent | 94 |

For example, composition 1 was the blank experiment, wherein the octane number of the hydrocarbon fuel without any additives was tested. It was found out that the octane number of the hydrocarbon fuel was 91.4. The water-hydrocarbon fuel emulsion 2 comprised 99.1% by weight of hydrocarbon fuel, 0.65% by weight of water, 0.088% by weight of span 80, 0.0417% by weight of tween 20, 0.0003% by weight of sodium dodecyl sulphate and 0.12% by weight of borane-tetrahydrofuran. The resulting emulsion had HLB value of 9.21 and the emulsion was milky. Hence this water-hydrocarbon fuel emulsion was considered undesired. Similarly, water-hydrocarbon fuel emulsion 3 obtained from the varying % weight as tabulated in Table 1, had HLB value 9.21 and was found to be milky. Water-hydrocarbon fuel emulsion 4 had HLB value 10.5 and appeared translucent and hazy.

The water-hydrocarbon fuel emulsion 5 and 6 were transparent with HLB value 7.84 and had an octane number higher than the hydrocarbon fuel (composition 1). Water-hydrocarbon fuel emulsion 5 comprised 97.11% by weight of hydrocarbon fuel, 0.6344% by weight of water, 1.4363% by weight of span 80, 0.706% by weight of tween 20, 0.0003% by weight of sodium dodecyl sulphate and 0.113% by weight of borane-tetrahydrofuran. The resulting emulsion 5 had HLB value of 7.84 and the emulsion was transparent with octane number 92.6. Similarly, water-hydrocarbon fuel emulsion 6 comprised 95.853% by weight of hydrocarbon fuel, 1.898% by weight of water, 1.4321% by weight of span 80, 0.704% by weight of tween 20, 0.0003% by weight of sodium dodecyl sulphate and 0.1126% by weight of borane-tetrahydrofuran. The resulting emulsion 6 had HLB value of 7.84 and the emulsion was transparent with octane number 94. Thus, the emulsion 5 and 6 were the best emulsion with an optimized emulsifying blend and the emulsion having HLB value in the range of 7-9 with increased octane number.

Example 2

Preparation of the Emulsion

The process for the preparation of water-hydrocarbon emulsion comprised mixing the at least one oil-soluble nonionic surfactant with the at least one hydrocarbon fuel under constant stirring for a time period in the range of 5 to 20 minutes to obtain a first mixture; dissolving the at least one water-soluble nonionic surfactant in water at a temperature in the range of 70° C. to 90° C. under constant stirring to obtain a second mixture; adding the at least one ionic surfactant to the second mixture at a temperature in the range of 70° C. to 90° C. under constant stirring to obtain a third mixture; blending the first mixture and the third mixture by drop-wise addition of the third mixture to the first mixture maintaining at a temperature in the range of 0° C. to 5° C. for a time period in the range of 1-30 minutes to obtain a transparent mixture; the transparent mixture is further subjected to sonication for a time period in the range of 15-60 minutes; and dissolving the at least one inorganic hydride with the transparent mixture at a temperature in the range of 25° C. to 40° C. to obtain the water-hydrocarbon fuel emulsion.

The process of preparation of emulsion comprised: mixing 1.2-2.0% by weight of at least one oil-soluble nonionic surfactant (span 80) with 87-99% by weight of at least one hydrocarbon fuel(gasoline) to obtain a first mixture; b) dissolving 0.5-1.0% by weight of at least one water-soluble nonionic surfactant(tween 20) in 0.1-10% by weight of water to obtain a second mixture; c) adding 0.0001 to 0.0005% by weight of at least one ionic surfactant (sodium dodecyl sulphate) to the second mixture to obtain a third mixture; d) blending the first mixture and the third mixture to obtain a transparent mixture; and e) dissolving the at least one inorganic hydride(borane-tetrahydrofuran) with the transparent mixture to obtain the water-hydrocarbon fuel emulsion.

For instance, the water-hydrocarbon fuel emulsion 5 was obtained by the process explained herein. mixing 1.4363% by weight of span 80 with 97.11% by weight of gasoline under constant stirring for a time period of 10 minutes to obtain a first mixture. Then dissolved 0.706% by weight of tween 20 in 0.6344% by weight water at a temperature of 80° C. under constant stirring to obtain a second mixture. This was followed by the addition of 0.0003% by weight of sodium dodecyl sulphate to the second mixture at a temperature of 80° C. under constant stirring to obtain a third mixture. The obtained first mixture and the third mixture was blended by drop-wise addition of the third mixture to the first mixture for a time period of 2 minutes to obtain a transparent mixture. While blending the first mixture was maintained at a temperature of 0° C. The temperature differential between the two mixture was crucial to make a transparent thermoreversible emulsion and to attain thermal equilibrium by increasing the interface and by reducing the droplet size. The transparent mixture was further subjected to sonication for a time period of 30 minutes. To this transparent mixture, 0.113% by weight of borane-tetrahydrofuran was dissolved at a temperature in the range of 25° C. to 40° C. to obtain the water-hydrocarbon fuel emulsion 5. Inorganic hydride must be added to the homogenous emulsion, and not to water, because the addition of inorganic hydride to water would result in a reaction of the hydride with water and instantaneous release of hydrogen.

All the water-hydrocarbon fuel emulsion of the present disclosure were prepared by the process explained herein. Any deviation in the sequence resulted in an unclear, non-homogeneous mixture of water and hydrocarbon fuel.

Example 3

Octane Number Enhancement

The water-hydrocarbon emulsion of varying weight percentages of water, hydrocarbon fuel, the emulsifying blend and the inorganic hydride were prepared as per the preparation process elucidated in Example 2. The emulsifying blend was developed as explained in Example 1 and the emulsion was obtained by primarily changing the gasoline and the water content. The research octane number was then measured, and the best working emulsion was identified. Table 2 shows the various emulsion compositions and their respective octane number. The emulsions were tested for research octane number measurement in the CFRR engine.

TABLE 2

| S. No | Hydrocarbon fuel (% weight) | Water (% weight) | Emulsifying blend (% weight) Span 80 | Tween 20 | Sodium dodecyl sulphate | Inorganic Hydride (Borane-Tetrahydrofuran) (% weight) | Research Octane number |
|---|---|---|---|---|---|---|---|
| 1 | 100 | 0 | 0 | 0 | 0 | 0 | 91.4 |
| 2 | 99.884 | 0 | 0 | 0 | 0 | 0.116 | 91.6 |
| 3 | 97.854 | 0 | 1.4389 | 0.7071 | 0 | 0 | 91.7 |
| 4 | 97.538 | 0.3175 | 1.4376 | 0.7066 | 0.0003 | 0 | 91.9 |
| 5 | 97.425 | 0.3174 | 1.4373 | 0.707 | 0.0003 | 0.113 | 92.1 |
| 6 | 97.313 | 0.3172 | 1.4371 | 0.7064 | 0.0003 | 0.226 | 92.4 |
| 7 | 97.11 | 0.6344 | 1.4363 | 0.706 | 0.0003 | 0.113 | 92.6 |
| 8 | 96.795 | 0.9513 | 1.435 | 0.7054 | 0.0003 | 0.113 | 93.0 |
| 9 | 96.481 | 1.2666 | 1.4342 | 0.7049 | 0.0003 | 0.113 | 93.6 |
| 10 | 96.167 | 1.5822 | 1.4331 | 0.7044 | 0.0003 | 0.113 | 93.9 |
| 11 | 95.853 | 1.898 | 1.4321 | 0.704 | 0.0003 | 0.1126 | 94.0 |

Table 2 illustrates the criticality of the weight percentage of each component in obtaining a desired water-hydrocarbon fuel emulsion. For example, in comparing emulsion composition 2 and 3 from Table 2, the presence of an emulsifying blend helped in increasing the octane number and also in obtaining a transparent emulsion. And while comparing emulsion composition 4 and 5, the presence of inorganic hydride also played an important role in enhancing the octane number. The emulsion composition 6 had twice the inorganic hydride compared to emulsion composition 5, and the octane number was found to be increased. In comparing the emulsion composition 7, 8, 9, 10 and 11, the weight percentage of water was increased gradually, and the corresponding amount of gasoline was decreased. This increase in the weight percentage of water yielded an increase in octane number respectively. Hence, from the Table 2 it can be observed that the emulsion composition 11 comprising 95.853% of gasoline, 1.898% by weight of water, 1.4321% by weight of span 80, 0.704% by weight of tween 20, 0.0003% by weight of sodium dodecyl sulphate and 0.1126% by weight of borane-tetrahydrofuran had the maximum octane number of 94 and was considered the favorable water-hydrocarbon fuel emulsion of the present disclosure.

The addition of water to the hydrocarbon fuel enhanced the octane number of the fuel. This was because the higher heat capacity of water delayed combustion and also water quenches free radicals, thereby inhibiting chain propagation during the initial combustion phase. The emulsion also resulted in an elevation of boiling point of the fuel. An inorganic hydride played a critical synergistic role by producing hydrogen in the presence of dispersed water during the compression cycle which increased the octane number of the fuel. Also acting as a reducing agent, an inorganic hydride can delay oxidation and in turn increase the RON value.

Example 4

Thermoreversible Property of the Emulsion of the Present Disclosure

As explained in Example 2, the preparation of the water-hydrocarbon fuel emulsion is sequential, and it is important to maintain the said temperature to obtain a thermoreversible emulsion. For evaluating the stability of the water-hydrocarbon fuel emulsion, thermoreversiblity measurements are essential. The stability of any emulsion decreases with increasing droplet size of the dispersed phase. Bigger droplets increase scattering thereby reducing transparency and transmittance of the liquid. Therefore, measuring transmittance values at varying temperatures indicated the stability of the emulsion. The transmittance values were measured in a UV-Vis spectrophotometer.

For thermoreversible measurements, two emulsions were prepared as explained in Table 3 and were tested for transmittance values.

TABLE 3

| Water-hydrocarbon emulsion | Gasoline (weight %) | Water (weight %) | SPAN 80 (weight %) | Tween 20 (weight %) | Sodium dodecyl sulphate (weight %) | Borane-THF (weight %) | HLB value | Emulsion appearance |
|---|---|---|---|---|---|---|---|---|
| Emulsion A | 97.12 | 0.634 | 1.4344 | 0.698 | 0 | 0.114 | 7.84 | Transparent |
| Emulsion B | 97.12 | 0.634 | 1.4338 | 0.6979 | 0.0003 | 0.1142 | 7.84 | Transparent |

2 ml of each emulsion AB was taken along with gasoline as a reference and their corresponding transmittance was recorded at a particular temperature at 486 nm. The absorption window was initially kept from 10° C. to 60° C., the heating/cooling step was kept at 2° C./min and the data was collected with a step of 5° C. Then the emulsion was first cooled to 10° C. and was then heated to 60° C. and the transmittance values were recorded.

TABLE 4

| | Transmittance | |
|---|---|---|
| Temperature | Emulsion A | Emulsion B |
| 10° C. (Forward) | 3.46 | 9.71 |
| 15° C. (Forward) | 9.6 | 10.01 |
| 20° C. (Forward) | 5.5 | 9.88 |
| 25° C. (Forward) | 13.6 | 14.2 |
| 30° C. (Forward) | 27.55 | 24.19 |
| 35° C. (Forward) | 24.9 | 31.19 |
| 40° C. (Forward) | 18.14 | 17.31 |
| 45° C. (Forward) | 0.31 | 9.12 |
| 50° C. (Forward) | 0.01 | 0.01 |
| 55° C. (Forward) | 0.01 | 0.01 |
| 60° C. (Forward) | 0.01 | 0.01 |
| 55° C. (Reverse) | 0.01 | 0.01 |
| 50° C. (Reverse) | 0.01 | 0.01 |
| 55° C. (Reverse) | 0.01 | 0.01 |
| 45° C. (Reverse) | 0.01 | 2.17 |
| 40° C. (Reverse) | 0.54 | 4.61 |
| 35° C. (Reverse) | 17.02 | 19.11 |
| 30° C. (Reverse) | 26.02 | 29.56 |
| 25° C. (Reverse) | 29.08 | 28.64 |
| 20° C. (Reverse) | 19.07 | 11.34 |
| 15° C. (Reverse) | 12.08 | 7.89 |
| 10° C. (Reverse) | 5.2 | 1.02 |

Table 4 provides the values of transmittance data for the emulsions A & B. Higher the transmittance, higher was the transparency of the liquid. The transmittance values >18 were found to be visually transparent. Transmittance values <4 were found to be completely turbid whereas transmittance values between 4-18 were found to be translucent. Hence it can be understood that the water-hydrocarbon fuel emulsion of the present disclosure was found to be transparent at a temperature range of 10° C. to 60° C., more specifically 25° C. to 45° C., was thermoreversible and hence was stable in the temperature range of 10° C. to 60° C.

Although the subject matter has been described in considerable detail with reference to certain examples and implementations thereof, other implementations are possible.

Advantages of the Present Disclosure

The present disclosure provides a water-hydrocarbon fuel emulsion comprising: a) 87-99% by weight of at least one hydrocarbon fuel with respect to the emulsion; b) 0.1-10% by weight of water with respect to the emulsion; c) 1-3% by weight of an emulsifying blend with respect to the emulsion; and d) 0.05-1% by weight of at least one inorganic hydride, wherein the emulsifying blend comprises i) 1.2-2.0% by weight of at least one oil-soluble nonionic surfactant with respect to the emulsion, ii) 0.5-1.0% by weight of at least one water-soluble nonionic surfactant with respect to the emulsion, and iii) 0.0001 to 0.0005% by weight of at least one ionic surfactant with respect to the emulsion. The present disclosure reveals a water-hydrocarbon fuel emulsion having HLB in the range of 7 to 9. The water-hydrocarbon fuel emulsion of the present disclosure possesses a high octane number in the range of 90 to 96. More specifically, the octane number of the water-hydrocarbon fuel emulsion is greater than the base hydrocarbon fuel. The water-hydrocarbon fuel emulsion is thermoreversible at a temperature in the range of 10° C. to 60° C. The water-hydrocarbon fuel emulsion of the present disclosure has transmittance values in the range of 0.1 to 35. The present disclosure provides a sequential preparation process for obtaining the homogenous transparent hydrocarbon fuel emulsion. Enhancement in the octane number of water-hydrocarbon fuel emulsion of the present disclosure is better than that of emulsified fuel comprising ethanol, higher alcohols and conventional aromatic nitrogen compounds.

We claim:

1. A water-hydrocarbon fuel emulsion comprising:

a) 87-99% by weight of at least one hydrocarbon fuel with respect to the emulsion;

b) 0.1-10% by weight of water with respect to the emulsion;

c) 1-3% by weight of an emulsifying blend with respect to the emulsion; and d) 0.05-1% by weight of at least one inorganic hydride with respect to the emulsion, wherein the emulsifying blend comprises a) at least one oil-soluble nonionic surfactant; b) at least one water-soluble nonionic surfactant; and c) at least one ionic surfactant, and wherein the emulsion has hydrophilic-lipophilic balance (HLB) in a range of 7 to 9.

2. The water-hydrocarbon fuel emulsion as claimed in claim 1, wherein the at least one hydrocarbon fuel is selected from a group consisting of gasoline, base fuel, fuel, crude oil, diesel fuel, kerosene, gas oil, hydrocarbon oil, and combinations thereof.

3. The water-hydrocarbon fuel emulsion as claimed in claim 1, wherein the emulsifying blend comprises 1.2-2.0% by weight of at least one oil-soluble nonionic surfactant with respect to the emulsion, 0.5-1.0% by weight of at least one water-soluble nonionic surfactant with respect to the emulsion, and 0.0001 to 0.0005% by weight of at least one ionic surfactant with respect to the emulsion.

4. The water-hydrocarbon fuel emulsion as claimed in claim 1, wherein the at least one oil-soluble nonionic surfactant is selected from a group consisting of span 80, lauramide diethyl amine, glycerol tristearate, sorbitan monopalmitate, span 20, polysorbate 20, glycerol monooleate, sucrose stearate, and combinations thereof.

5. The water-hydrocarbon fuel emulsion as claimed in claim 1, wherein the at least one water-soluble nonionic surfactant is selected from a group consisting of tween 20, tergitol, Triton X, PEG-200, glycerol monolaurate, nonoxynol-9, polysorbate 80, tween 40, polyoxyethylene lauryl ether, and combinations thereof.

6. The water-hydrocarbon fuel emulsion as claimed in claim 1, wherein the at least one ionic surfactant is selected from the group consisting of sodium octyl sulfate, sodium dodecyl sulfate, magnesium stearate, 3-(N,N-dimethylpalmitylammonio)propanesulfonate, ammonium lauryl sulfate, and combinations thereof.

7. The water-hydrocarbon fuel emulsion as claimed in claim 1, wherein the at least one inorganic hydride is selected from a group consisting of borane-tetrahydrofuran, borane-dimethylsulphide, lithium aluminum borohydride, sodium borohydride, and combinations thereof.

8. The water-hydrocarbon fuel emulsion as claimed in claim 1, wherein the emulsion is thermoreversible at a temperature in a range of 10° C. to 60° C.

9. The water-hydrocarbon fuel emulsion as claimed in claim 1, wherein the emulsion has an octane number in a range of 90 to 96.

10. A process for preparing the water-hydrocarbon emulsion as claimed in claim 1, the process comprising:

a) mixing the at least one oil-soluble nonionic surfactant with the at least one hydrocarbon fuel to obtain a first mixture;

b) dissolving the at least one water-soluble nonionic surfactant in water to obtain a second mixture;

c) adding the at least one ionic surfactant to the second mixture to obtain a third mixture;

d) blending the first mixture and the third mixture to obtain a transparent mixture, wherein blending the first mixture and the third mixture is carried out by maintaining the first mixture at a temperature in a range of 0° C. to 5° C.; and e) dissolving the at least one inorganic hydride with the transparent mixture to obtain the water-hydrocarbon fuel emulsion.

11. The process as claimed in claim 10, wherein mixing the at least one oil-soluble nonionic surfactant with the at least one hydrocarbon fuel is carried out under constant stirring for a time period in a range of 5 to 20 minutes.

12. The process as claimed in claim 10, wherein dissolving the at least one water-soluble nonionic surfactant in water is carried out at a temperature in a range of 70° C. to 90° C. under constant stirring.

13. The process as claimed in claim 10, wherein adding the at least one ionic surfactant to the second mixture is carried out at a temperature in a range of 70° C. to 90° C. under constant stirring.

14. The process as claimed in claim 10, wherein blending the first mixture and the third mixture is done by drop-wise addition of the third mixture to the first mixture for a time period in a range of 1-30 minutes to obtain the transparent mixture.

15. The process as claimed in claim 10, wherein the transparent mixture is further subjected to sonication for a time period in a range of 15-60 minutes.

16. The process as claimed in claim 10, wherein dissolving the at least one inorganic hydride with the transparent mixture is carried out at a temperature in a range of 25° C. to 40° C.

* * * * *